US011821429B2

(12) United States Patent
Mackey et al.

(10) Patent No.: US 11,821,429 B2
(45) Date of Patent: Nov. 21, 2023

(54) SINGLE WHEEL MULTI-STAGE RADIALLY-LAYERED REGENERATIVE PUMP

(71) Applicant: EATON INTELLIGENT POWER LIMITED, Dublin (IE)

(72) Inventors: Cody M. Mackey, Mentor, OH (US); Martin A. Clements, Loveland, OH (US); Matthew A. Reinhardt, Painesville, OH (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 46 days.

(21) Appl. No.: 17/192,309

(22) Filed: Mar. 4, 2021

(65) Prior Publication Data

US 2021/0277901 A1 Sep. 9, 2021

Related U.S. Application Data

(60) Provisional application No. 62/984,930, filed on Mar. 4, 2020.

(51) Int. Cl.

| | |
|---|---|
| ***F04D 1/06*** | (2006.01) |
| ***F04D 29/62*** | (2006.01) |
| ***F04D 29/22*** | (2006.01) |

(52) U.S. Cl.

CPC ..... *F04D 1/066* (2013.01); *F04D 29/2261* (2013.01); *F04D 29/62* (2013.01)

(58) Field of Classification Search

CPC . F04D 1/06; F04D 5/002; F04D 5/003; F04D 5/005; F04D 23/008; F04D 29/188

See application file for complete search history.

(56) References Cited

U.S. PATENT DOCUMENTS 3,119,343 A * 1/1964 White ..... F04D 5/002 417/357
3,576,375 A 4/1971 Jackson
(Continued)

FOREIGN PATENT DOCUMENTS

DE 2112762 A1 3/1971
GB 2 073 819 A 10/1981
(Continued)

OTHER PUBLICATIONS

Great Britain Search Report for Application No. GB2102944.2 dated Jul. 29, 2021.

(Continued)

*Primary Examiner* — David E Sosnowski
*Assistant Examiner* — Jackson N Gillenwaters
(74) *Attorney, Agent, or Firm* — Merchant & Gould P.C.

(57) ABSTRACT

A multi-stage regenerative rotary pump assembly includes a housing, and an elongated shaft received in the housing for rotation about a rotational axis. The shaft has a longitudinal axis aligned with the rotational axis. A rotary member is operatively connected to the shaft and dimensioned for receipt in the housing. The rotary member has opposite, first and second faces axially spaced from one another in a direction of the longitudinal axis. At least the first face of the rotary member includes a first pump stage having a first stage inlet and a first stage outlet in fluid communication therewith. At least the first face includes a second pump stage having a second stage inlet and a second stage outlet in fluid communication therewith, and the second stage inlet is configured to be in fluid communication with the first stage outlet.

24 Claims, 5 Drawing Sheets

(56) References Cited

U.S. PATENT DOCUMENTS

| | | | | |
|---|---|---|---|---|
| 4,408,952 | A | 10/1983 | Schweinfurter | |
| 4,556,363 | A * | 12/1985 | Watanabe | F02M 37/048 415/55.6 |
| 4,678,395 | A | 7/1987 | Schweinfurter | |
| 5,017,086 | A * | 5/1991 | Hansen | F04D 29/2238 415/55.5 |
| 5,215,429 | A * | 6/1993 | Sun | F04D 5/007 415/55.1 |
| 5,456,574 | A * | 10/1995 | Donnelly | F04D 9/048 417/69 |
| 6,022,197 | A | 2/2000 | Cygnor et al. | |
| 6,059,537 | A | 5/2000 | Cygnor | |
| 9,249,806 | B2 * | 2/2016 | Talaski | F04D 5/007 |
| 9,568,010 | B2 * | 2/2017 | Adhvaryu | F04D 29/441 |
| 10,907,598 | B2 | 2/2021 | Clements | |
| 10,927,937 | B2 | 2/2021 | Downs et al. | |
| 2007/0264117 | A1 | 11/2007 | Yoshida et al. | |
| 2014/0072425 | A1 | 3/2014 | Jeswani et al. | |
| 2019/0277233 | A1 | 9/2019 | Clements | |
| 2021/0277902 | A1 | 9/2021 | Mackey et al. | |

FOREIGN PATENT DOCUMENTS

| | | | |
|---|---|---|---|
| GB | 2 253 246 | A | 9/1992 |
| KR | 1020070025125 | A | 3/2007 |
| WO | 2004/005722 | A1 | 1/2004 |
| WO | 2007/095047 | A2 | 8/2007 |
| WO | WO 2017/079309 | A1 | 5/2017 |

OTHER PUBLICATIONS

French Search Report for Application No. FR 2102090 dated Dec. 8, 2022.

Examination Report issued in related GB Application No. GB2102944.2, dated Aug. 15, 2023.

* cited by examiner

SINGLE WHEEL MULTI-STAGE RADIALLY-LAYERED REGENERATIVE PUMP

This application claims the priority benefit of U.S. Provisional Application Ser. No. 62/984,930, filed Mar. 4, 2020, the entire disclosure of which is incorporated herein by reference.

BACKGROUND

This invention relates to a pump assembly, and more particularly to a rotational, regenerative pump used, in part, as part of the pump assembly for start-up and/or supplemental pumping needs as part of a pressurized fluid system such as used in modern day jet engine fuel systems.

Centrifugal-type fuel pumps are widely used in these pressurized fluid systems such as engine fuel systems. The centrifugal pump produces pressure as a function of the rotating speed squared. In a typical centrifugal pump application, insufficient pump output pressure is generated to start the engine when the pump is rotated at typical starting speeds (i.e., less than around 20 to 30% of operating speed where operating speed is, for example, from about 20,000 revolutions per minute (rpm) to about 40,000 rpm and thus starting speed may range from about 4000 rpm to about 12,000 rpm).

Use of a regenerative pumping element, particularly for start-up in a high-speed centrifugal fuel pump system, is generally known in the art. For example, regenerative pumps are commonly employed in these systems as shown and described in commonly owned WO 2017/079309 A1 and US 2019/0277233 A1, the entire disclosures of which are hereby expressly incorporated herein by reference. These traditional regenerative pumps produce pressure proportional to wheel diameter. Still higher pressure at start-up is desired, and thus modifications to these known arrangements are desirable.

A need exists for an improved arrangement that provides at least one or more of the above-described features, as well as still other features and benefits.

SUMMARY

This disclosure provides an improved multi-stage regenerative pump arrangement.

The multi-stage regenerative rotary pump assembly includes a housing, and an elongated shaft received in the housing for rotation about a rotational axis. The shaft has a longitudinal axis aligned with the rotational axis. A rotary member is operatively connected to the shaft and dimensioned for receipt in the housing. The rotary member has opposite, first and second faces axially spaced from one another in a direction of the longitudinal axis. At least the first face of the rotary member includes a first pump stage having a first stage inlet and a first stage outlet in fluid communication therewith. At least the first face includes a second pump stage having a second stage inlet and a second stage outlet in fluid communication therewith, and the second stage inlet is configured to be in fluid communication with the first stage outlet.

The first pump stage is radially spaced relative to the longitudinal axis from the second pump stage, and in one embodiment the first pump stage is located radially inward of the second pump stage.

The rotary member may have either a constant axial thickness or a varying axial thickness over a radial extent thereof.

The rotary member in one version has a greater thickness in a central radial region and a reduced thickness region adjacent an outer perimeter of the rotary member.

In one version, one of the first pump stage and the second pump stage is located in the central radial region, and in another version both the first pump stage and the second pump stage are located in the reduced thickness region.

In one embodiment, the rotary member is formed of first, second, and third plate members joined together, and in one version thereof, the second plate member has a greater radial dimension than the first and third plate member positioned on opposite axial sides of the second plate member. At least one of the first pump stage and the second pump stage is located in the second plate member, and the first pump stage may be located in at least one of the first and third plate members.

Each of the first and third plate members may include the first pump stage formed therein, and may be located along the outer peripheries of the first and third plate members.

The second pump stage may be formed in an outer perimeter of the second plate member.

The first pump stage is located in at least one of the first and third plate members.

The first pump stage is formed radially inward of the second pump stage in one version.

The housing is configured to form a passage that interconnects the first pump stage with the second pump stage, for example, the passage interconnects the outlet of the first pump stage with the inlet of the second pump stage.

The first pump stage is formed on both of the first and second faces of the rotary member and the second pump stage is formed on both of the first and second faces of the rotary member.

The system includes a centrifugal pump mounted for rotation on the same shaft that drives the regenerative pump.

A method of making a regenerative rotary pump assembly includes providing a housing, mounting an elongated shaft in the housing for rotation about a rotational axis, connecting a rotary member to the shaft and dimensioned for receipt in the housing, the rotary member having opposite, first and second axially spaced faces, forming a first pump stage having a first stage inlet and a first stage outlet in fluid communication therewith on at least the first face of the rotary member, and forming a second pump stage having a second stage inlet and a second stage outlet in fluid communication therewith on at least the first face, and configuring the second stage inlet to be in fluid communication with the first stage outlet.

A primary advantage of the disclosure resides in the increased pressure developed with the multi-stage regenerative pump.

A secondary benefit is associated with the increased pressure that results from a structure that does not adversely increase a size of the fluid system, and instead will be able to reduce the envelope of the pump arrangement for a desired output in the fluid system in an environment where there is limited available space.

Another advantage relates to the ability to add increased functionality and performance without adding undesired weight to the fluid system.

Yet another benefit is associated with increased pumping capability over known traditional regenerative pump arrangements of the same diameter.

Still other benefits and advantages of the present disclosure will become more apparent from reading and understanding the following detailed description.

DETAILED DESCRIPTION

Figure 1:
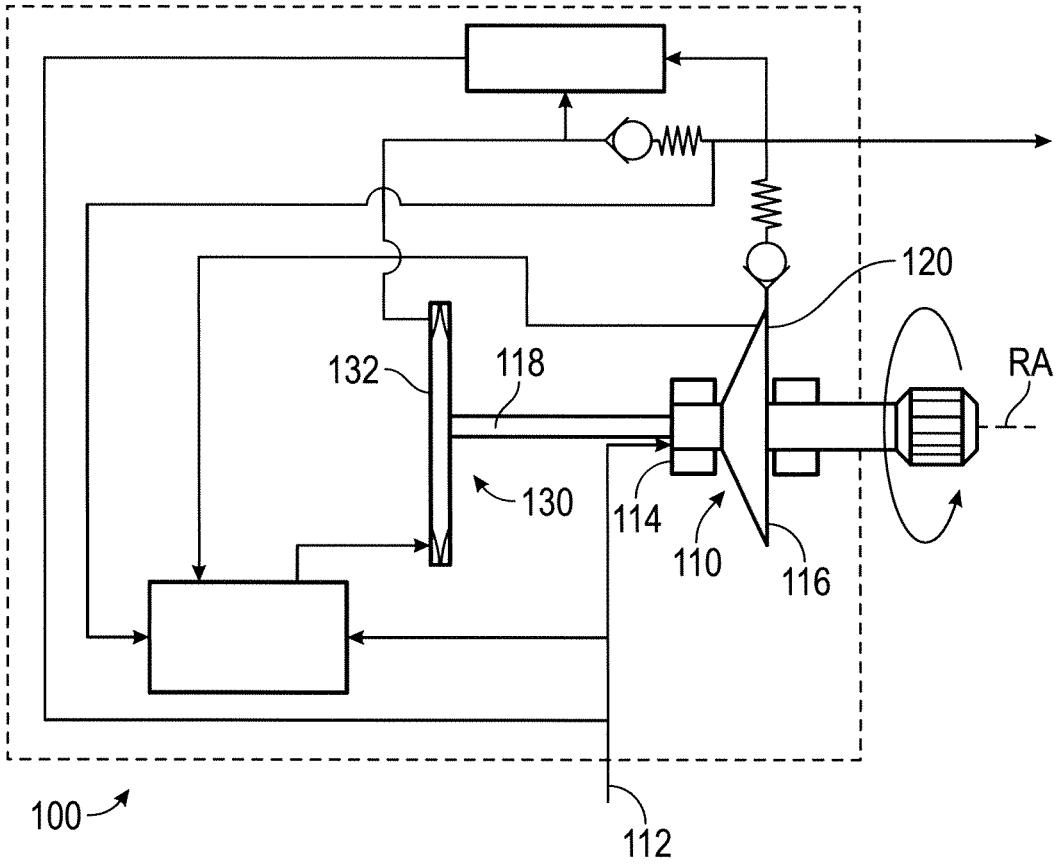
FIG. 1 is a schematic representation of a portion of a fluid system that illustrates one use of the multi-stage regenerative pump in a rotary pump assembly.

The following description with reference to the accompanying drawings is provided to assist in a comprehensive understanding of one or more embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. Various exemplary embodiments of the present disclosure are not limited to the specific details of different embodiments and should be construed as including all changes and/or equivalents or substitutes included in the ideas and technological scope of the appended claims. In describing the drawings, where possible similar reference numerals are used for similar elements.

The terms "include" or "may include" used in the present disclosure indicate the presence of disclosed corresponding functions, operations, elements, and the like, and do not limit additional one or more functions, operations, elements, and the like. In addition, it should be understood that the terms "include", "including", "have" or "having" used in the present disclosure are to indicate the presence of components, features, numbers, steps, operations, elements, parts, or a combination thereof described in the specification, and do not preclude the presence or addition of one or more other features, numbers, steps, operations, elements, parts, or a combination thereof.

The terms "or" or "at least one of A or/and B" used in the present disclosure include any and all combinations of words enumerated with them. For example, "A or B" or "at least one of A or/and B" mean including A, including B, or including both A and B.

Although the terms such as "first" and "second" used in the present disclosure may modify various elements of the different exemplary embodiments, these terms do not limit the corresponding elements. For example, these terms do not limit an order and/or importance of the corresponding elements, nor do these terms preclude additional elements (e.g., second, third, etc.) The terms may be used to distinguish one element from another element. For example, a first mechanical device and a second mechanical device all indicate mechanical devices and may indicate different types of mechanical devices or the same type of mechanical device. For example, a first element may be named a second element without departing from the scope of the various exemplary embodiments of the present disclosure, and similarly, a second element may be named a first element.

It will be understood that, when an element is mentioned as being "connected" or "coupled" to another element, the element may be directly connected or coupled to another element, and there may be an intervening element between the element and another element. To the contrary, it will be understood that, when an element is mentioned as being "directly connected" or "directly coupled" to another element, there is no intervening element between the element and another element.

The terms used in the various exemplary embodiments of the present disclosure are for the purpose of describing specific exemplary embodiments only and are not intended to limit various exemplary embodiments of the present disclosure. As used herein, the singular forms are intended to include the plural forms as well, unless the context clearly indicates otherwise.

All of the terms used herein including technical or scientific terms have the same meanings as those generally understood by an ordinary skilled person in the related art unless they are defined otherwise. The terms defined in a generally used dictionary should be interpreted as having the same meanings as the contextual meanings of the relevant technology and should not be interpreted as having inconsistent or exaggerated meanings unless they are clearly defined in the various exemplary embodiments.

FIG. 1 generally illustrates a portion of a fluid pump system 100 that includes a pump shown in the preferred arrangement as a high-speed rotary kinetic pump, specifically a high-speed centrifugal pump 110, that operates on the order of up to 40,000 rpm. The centrifugal pump 110 defines a first or primary stage of the pump system 100. Fluid, which in this particular instance is fuel, is provided from an associated source 112 to pump inlet 114. Rotation of an inducer/impeller 116 of the centrifugal pump 110 about a rotational axis RA via a shaft 118 boosts the fuel pressure to the desired outlet flow and pressure level at centrifugal pump outlet 120.

A regenerative stage (sometimes referred to herein as a regenerative pump) 130 of the pump 110 is commonly driven by the shaft 118. The regenerative stage 130 preferably includes a rotary member, wheel, or impeller 132 secured to and operatively driven by the shaft 118. The rotary member 132 has a first stage preferably formed by a first set of vanes 134 preferably located radially inward of an outer perimeter or periphery 136 of the rotary member. The first set of vanes 134 are desirably located on both of opposite first and second faces 138, 140 of the rotary member 132, and thus are referenced as first vanes 134*a* on the first face 138 of the rotary member, and first vanes 134*b* on the second face 140 of the rotary member. Preferably, the first vanes 134*a*, 134*b* are located at the same radial location on the rotary member 132 relative to the rotational axis RA so that the vane location on both faces of the rotary member and at the same radial location provides a stable, pressure balanced arrangement.

Figure 2:
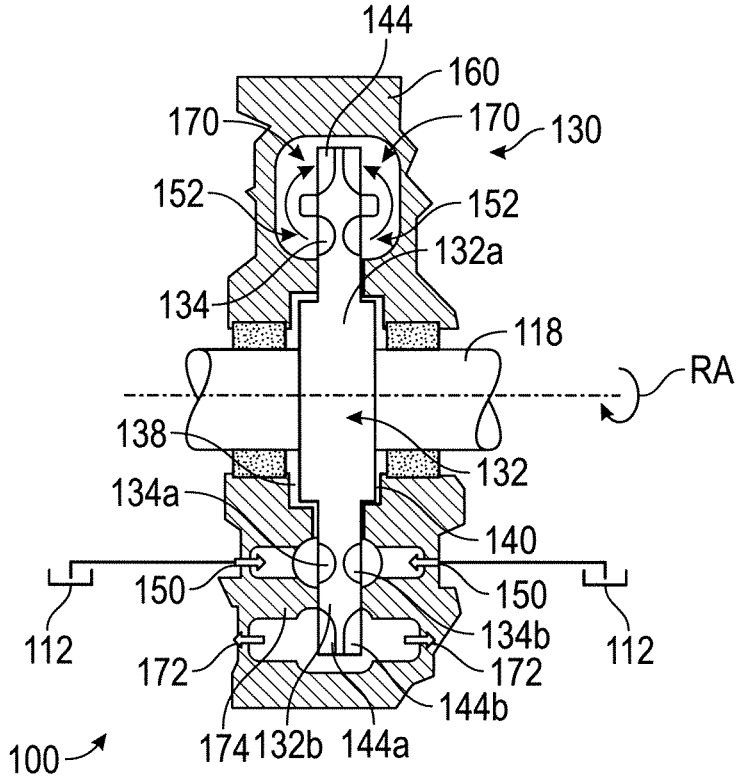
FIG. 2 is a schematic showing of one version of the multi-stage regenerative pump.

The rotary member 132 has a second stage formed by a second set of vanes 144 located radially outward of the first stage/first set of vanes 134 and adjacent the outer periphery 136 of the rotary member. The second set of vanes 144 are likewise located on both of the first and second faces 138, 140 of the rotary member 132, and thus are referenced as second vanes 144*a* on the first face 138 of the rotary member, and second vanes 144*b* on the second face 140 of the rotary member. In addition to being located radially outward of the first stage/first set of vanes 134 and adjacent the outer periphery, the second stage/second set of vanes 144 in at least the preferred arrangement of FIG. 2 are preferably located at the outermost perimeter of the rotary member 132. In addition, the rotary member 132 includes an axially thicker, radially central first portion 132*a* and a radially outer, axially thinner portion 132*b*.

Fluid from the fluid source 112 is provided to a first stage inlet 150. Here, a first stage inlet 150 is formed in the housing 160 and the first stage inlet includes inlet portion 150*a* formed in the housing on one side of the rotary member 132 that communicates with the first vanes 134*a* on the first face 138 of the rotary member, and inlet portion 150*b* formed in the housing on the other, axially opposite side of the rotary member that communicates with the first vanes 134*b* on the second face 140 of the rotary member. A first stage outlet 152 is formed in housing 160 and provided at a circumferentially spaced location from the first stage inlet 150. Similarly, a second stage inlet 170 is in fluid communication with the first stage outlet 152. As shown, the first state outlet 152 and the second stage inlet 170 are part of an enlarged cavity in the housing 160 so that fluid exiting the first stage of the regenerative pump 130 transfers to the second stage inlet 172. In this manner, the regenerative pump 130 imparts a first level of rotational energy to the fluid via the first stage vanes 134 and the pressurized fluid then enters the second stage inlet 170 where the rotational motion of the rotary member 132 about axis RA, adds additional energy to the fluid via the second vanes 144. The pressurized fluid then exits the regenerative stage pump via the second stage outlet 172. Preferably, the second stage outlet 172 is formed in the housing 160 at a circumferential location spaced from the second stage inlet 170. A land portion 174 separates the first stage inlet 150 from the second stage outlet 172, and it is also understood that the land portion 174 extends around at least a major circumferential portion of the housing 160 to segregate the first and second stages 134, 136 of the regenerative pump 130. One skilled in the art will also appreciate that although first and second stages are shown and described herein, the concept of a multi-stage regenerative pump does not preclude still further stages if desired or warranted by system requirements. Suitable inlet and outlets would be required to accommodate any additional stage(s).

Figure 3:
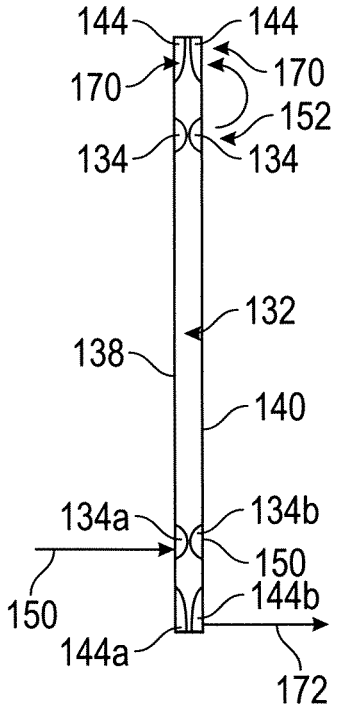
FIG. 3 is a showing of a first alternative regenerative pump member/wheel.

FIG. 3 schematically illustrates the rotary member 132 by itself, i.e., separate from the housing 160. In the embodiment of FIG. 3, the rotary member 132 has a single thickness over its entire radial extent. Otherwise, the rotary member 132 is structurally similar and operates in the same manner as that shown and described with reference to FIG. 2.

Figure 4:
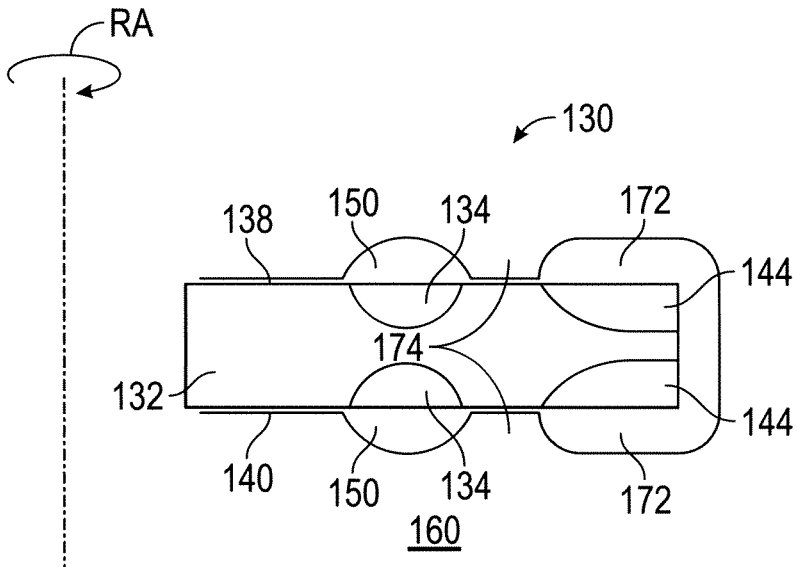
FIG. 4 is an enlarged view of a portion of the pump arrangements of either FIG. 2 or 3 showing the multi-stage features thereof.

Similarly, FIG. 4 is an enlarged view of the outer radial portion of the rotary member 132 (and could be either the rotary member of FIG. 2 or FIG. 3). It will be appreciated that the first stage vanes 134 and the second stage vanes 144 of the regenerative pump 130 are provided on at least one of the first face 138 or the second face 140 of the rotary member 138. Providing the vanes on both of the first and second faces 138, 140 of the rotary member 132 addresses pressure balancing of the assembly and maximizes the energy imparted by the regenerative stage 130 to the fluid in the limited envelope associated with the pump system 100, and particularly associated with the regenerative pump.

Suitable dynamic seals (not shown), thrust bearings (not shown), and journal bearings 180 are provided to seal and support rotational movement of these pump components relative to a pump housing 160.

Figure 5:
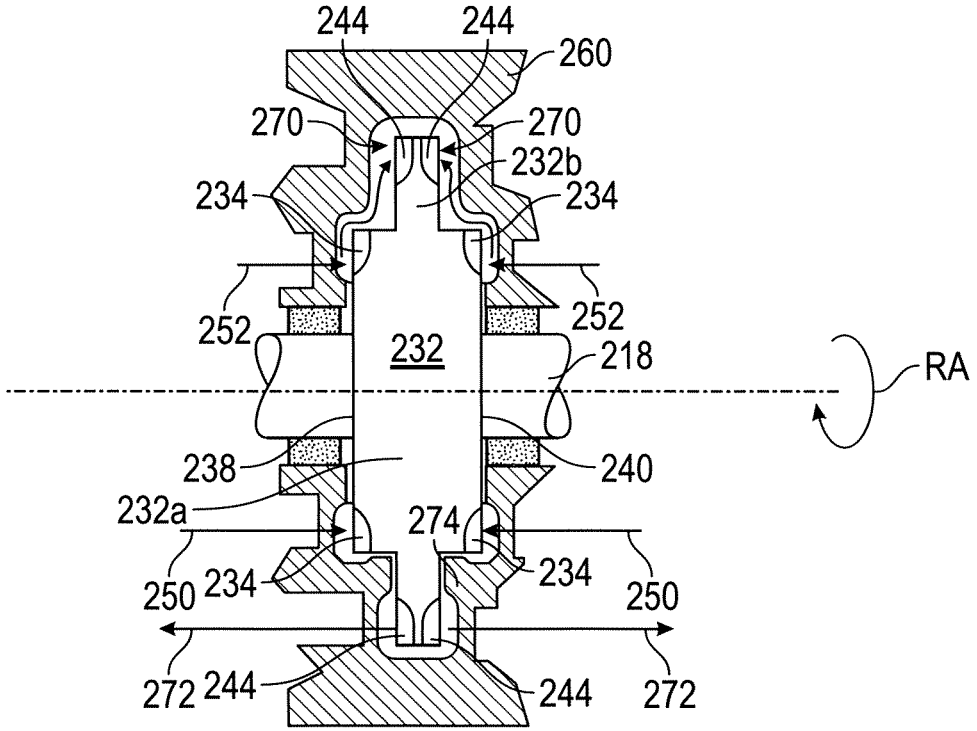
FIG. 5 is a schematic showing of another version of the multi-stage regenerative pump where the first and second stages are located on different axial portions of the pump member/wheel.
Figure 6:
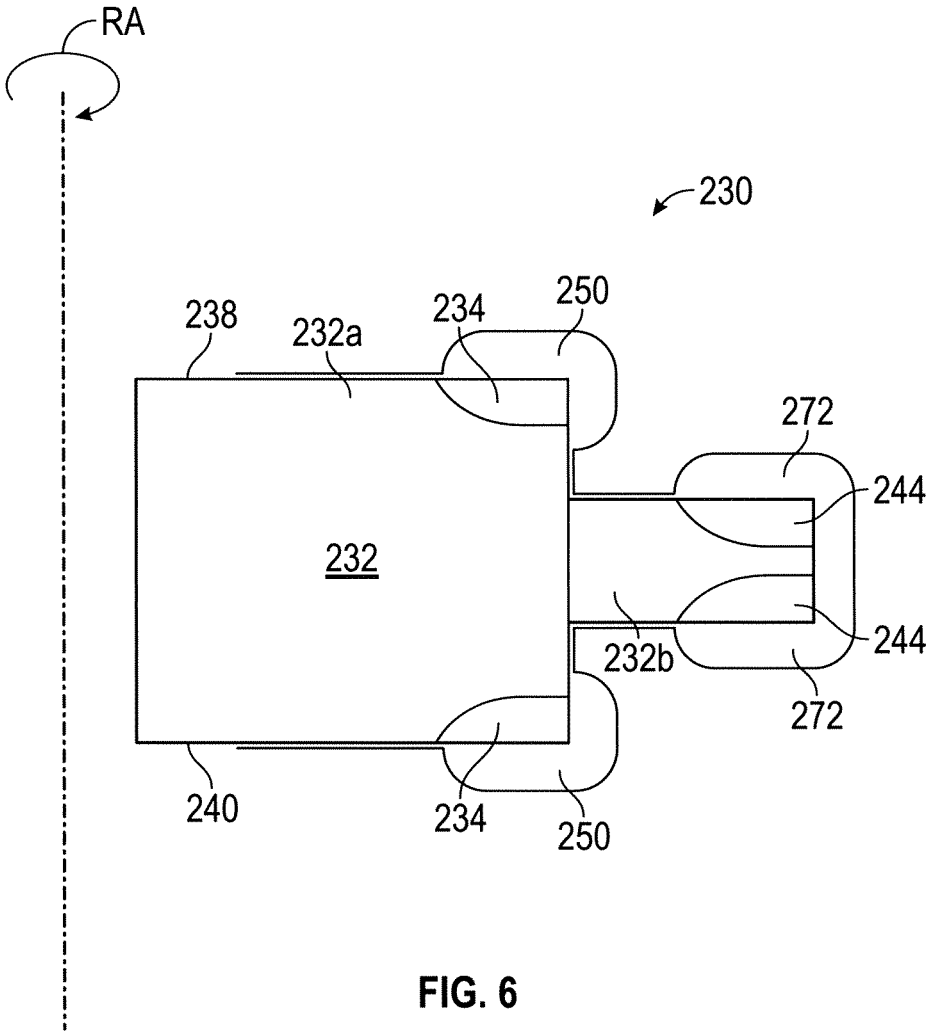
FIG. 6 is an enlarged view of a portion of the pump arrangement of FIG. 5 showing the multi-stage feature thereof.

FIGS. 5 and 6 are similar to the embodiment of FIG. 2 to the extent that the rotary member 232 has a dual thickness, i.e., a centrally thicker portion 232*a* and a thinner, radially outer portion 232*b*. Due to the similarities, like reference numerals in the 200 series are used to describe the components/elements of FIGS. 5 and 6 (e.g., rotary member 132 in FIGS. 2-4, is referred to as rotary member 232 in FIGS. 5-6). Shaft 218 rotates regenerative stage 230 of the pump 210 (and the shaft also is connected to the primary stage/centrifugal pump of the fluid system such as shown in FIG. 1).

The regenerative stage 230 (FIGS. 5-6) preferably includes a rotary member, wheel, or impeller 232. The rotary member 232 has vanes 234 preferably located adjacent the outer perimeter or periphery of the thicker portion 232*a* of the rotary member, and the vanes are preferably located on both of opposite first and second faces 236, 238 of the rotary member. In addition, the vanes 244 associated with the second stage are located on the thinner, radially outer portion 232*b*. Again, the vanes 244 are desirably located along the outer perimeter or periphery of the thinner region 232*b* of the rotary member 232. Each vane set 234, 244 is provided on both the first and second faces 238, 240 of the rotary member. First stage inlet 250, namely first stage inlet portions 250*a*, 250*b*, formed in the housing 260 (FIG. 5) communicates with the vanes 234 on the opposite faces 232*a*, 232*b*, respectively, of the rotary member 232. The first stage outlet 252 is an enlarged passage area in the housing cavity—preferably circumferentially spaced from the first stage inlet that communicates the pressurized fluid from the first stage with the second stage inlet 270. The second stage vanes 244 then impart further energy to the fluid before the pressurized fluid exits the rotary member 232 at second stage outlet 272 that is circumferentially spaced from the second stage inlet 270.

Figure 7:
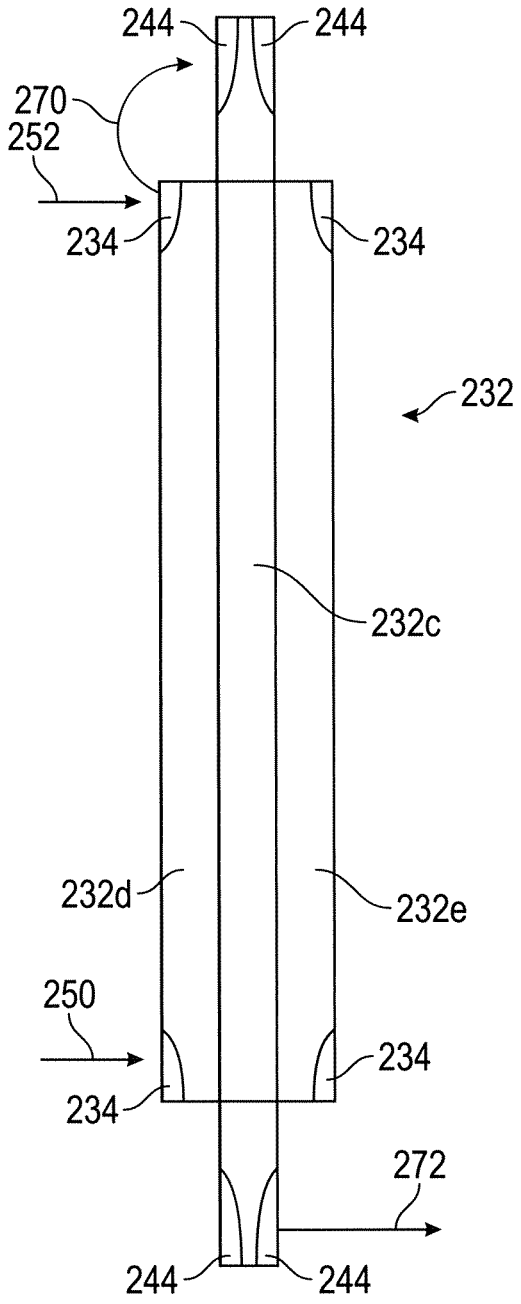
FIG. 7 is a schematic illustration of still another version of a multi-stage regenerative pump member/wheel.

FIG. 7 is still another variation of the embodiment of FIGS. 5 and 6 so that like reference numerals refer to like elements. The primary distinction is that the rotary member 232 is preferably formed from first (central) component 232*d* and second and third (outer) components 232*e*, 232*f* and the three components subsequently joined together to rotate together as a single rotary member 232. This arrangement provides some advantages in terms of manufacturing. The first stage vanes 234 are formed on the outer peripheries of the second and third components 232*e*, 232*f*, while the second stage vanes 244 are formed on the outer periphery of the central, first component 232*d*. The three component rotary member 232*d*, 232*e*, 232*f* is received in the housing 260 and operates in the same manner as described above.

This written description uses examples to describe the disclosure, including the best mode, and also to enable any person skilled in the art to make and use the disclosure. Other examples that occur to those skilled in the art are intended to be within the scope of the invention if they have structural elements that do not differ from the same concept or that do not differ from the literal language of the claims, or if they include equivalent structural elements with insubstantial differences from the same concept or from the literal language of the claims. Moreover, this disclosure is intended to seek protection for a combination of components and/or steps and a combination of claims as originally presented for examination, as well as seek potential protection for other combinations of components and/or steps and combinations of claims during prosecution.

Although specific advantages have been enumerated above, various embodiments may include some, none, or all of the enumerated advantages. Although exemplary embodiments are illustrated in the figures and description herein, the principles of the present disclosure may be implemented using any number of techniques, whether currently known or not. Moreover, the operations of the systems and apparatuses disclosed herein may be performed by more, fewer, or other components, and the methods described herein may include more, fewer, or other steps. Additionally, steps may be performed in any suitable order.

To aid the Patent Office and any readers of this application and any resulting patent in interpreting the claims appended hereto, applicants do not intend any of the appended claims or claim elements to invoke 35 USC 112 (f) unless the words "means for" or "step for" are explicitly used in the particular claim.

COMPONENT LIST

100 pump system
110 centrifugal pump
112 fluid source
114 pump inlet
116 inducer/impeller
118 shaft
120 centrifugal pump outlet
130 regenerative stage/pump
132 rotary member/wheel impeller (thicker portion 132*a*, thinner portion 132*b*)
134 $1^{st}$ stage/first vanes
136 outer perimeter/outer periphery
138 $1^{st}$ face
140 $2^{nd}$ face
144 $2^{nd}$ stage/second vanes
150 $1^{st}$ stage inlet (inlet portions 150*a*, 150*b*)
152 $1^{st}$ stage outlet
160 housing
170 $2^{nd}$ stage inlet
172 $2^{nd}$ stage outlet

We claim:

1. A multi-stage regenerative rotary pump assembly comprising:

a housing;

an elongated shaft received in the housing for rotation about a rotational axis, the shaft having a longitudinal axis aligned with the rotational axis;

a rotary member operatively connected to the shaft and dimensioned for receipt in the housing, the rotary member having opposite, first and second faces axially spaced from one another in a direction of the longitudinal axis;

at least the first face of the rotary member including a first pump stage having a first stage inlet and a first stage outlet in fluid communication therewith; and at least the first face including a second pump stage having a second stage inlet and a second stage outlet in fluid communication therewith, and the second stage inlet configured to be in fluid communication with the first stage outlet;

wherein the first stage outlet and the second stage inlet are disposed in an enlarged cavity at the first face of the rotary member so that fluid exiting the first pump stage transfers through the enlarged cavity along the first face to the second pump stage, and wherein the first stage inlet and the second stage outlet are separated by a land portion of the housing.

2. The regenerative rotary pump assembly of claim 1 wherein the first pump stage is radially spaced relative to the longitudinal axis from the second pump stage.

3. The regenerative rotary pump assembly of claim 2 wherein the first pump stage is located radially inward of the second pump stage.

4. The regenerative rotary pump assembly of claim 1 wherein the rotary member has a constant axial thickness.

5. The regenerative rotary pump assembly of claim 1 wherein the rotary member has a varying axial thickness over a radial extent.

6. The regenerative rotary pump assembly of claim 5 wherein the rotary member has a greater thickness in a central radial region and a reduced thickness region adjacent an outer perimeter of the rotary member.

7. The regenerative rotary pump assembly of claim 6 wherein both the first pump stage and the second pump stage are located in the reduced thickness region.

8. The regenerative rotary pump assembly of claim 6 wherein one of the first pump stage and the second pump stage is located in the central radial region.

9. The regenerative rotary pump assembly of claim 8 wherein the second pump stage is located in the reduced thickness region.

10. The regenerative rotary pump assembly of claim 1 wherein the rotary member is formed of first, second, and third plate members joined together.

11. The regenerative rotary pump assembly of claim 10 wherein the second plate member has a greater radial dimension than the first and third plate member positioned on opposite axial sides of the second plate member.

12. The regenerative rotary pump assembly of claim 11 wherein at least one of the first pump stage and the second pump stage is located in the second plate member.

13. The regenerative rotary pump assembly of claim 12 wherein the first pump stage is located in at least one of the first and third plate members.

14. The regenerative rotary pump assembly of claim 1 wherein the second pump stage is formed in an outer perimeter of the rotary member.

15. The regenerative rotary pump assembly of claim 14 wherein the first pump stage is formed radially inward of the second pump stage.

16. The regenerative rotary pump assembly of claim 1 wherein the housing is configured to form a passage that interconnects the first pump stage with the second pump stage.

17. The regenerative rotary pump assembly of claim 16 wherein the passage interconnects the outlet of the first pump stage with the inlet of the second pump stage.

18. The regenerative rotary pump assembly of claim 1 wherein the first pump stage is formed on both of the first and second faces of the rotary member and the second pump stage is formed on both of the first and second faces of the rotary member.

19. The regenerative rotary pump assembly of claim 1 further comprising a centrifugal pump mounted for rotation on the shaft.

20. A method of making a regenerative rotary pump assembly, the method comprising:

providing a housing;

mounting an elongated shaft in the housing for rotation about a rotational axis, the shaft having a longitudinal axis aligned with the rotational axis;

connecting a rotary member to the shaft and dimensioned for receipt in the housing, the rotary member having opposite, first and second faces axially spaced from one another in a direction of the longitudinal axis;

forming a first pump stage having a first stage inlet and a first stage outlet in fluid communication therewith on at least the first face of the rotary member; and forming a second pump stage having a second stage inlet and a second stage outlet in fluid communication therewith on at least the first face, and configuring the second stage inlet to be in fluid communication with the first stage outlet;

wherein the first stage outlet and the second stage inlet are disposed in an enlarged cavity at the first face of the rotary member so that fluid exiting the first pump stage transfers through the enlarged cavity along the first face to the second pump stage, and wherein the first stage inlet and the second stage outlet are separated by a land portion of the housing.

21. The regenerative rotary pump assembly of claim 1 wherein the second stage outlet is formed in the housing at a circumferential location spaced from the second stage inlet.

22. The regenerative rotary pump assembly of claim 1 wherein the land portion extends around at least a major circumferential portion of the housing to segregate the first and second pump stages.

23. The regenerative rotary pump assembly of claim 1 wherein the first face of the rotary member includes a circumferential wall that separates the first pump stage from the second pump stage, wherein the second pump stage is positioned radially outside the first pump stage, and wherein the enlarged cavity and the circumferential wall are arranged such that fluid exiting the first pump stage transfers through the enlarged cavity around the circumferential wall to the second pump stage.

24. The regenerative rotary pump assembly of claim 23 wherein the land portion of the housing opposes the circumferential wall, wherein the land portion extends around a majority of a circumferential portion of the housing, and wherein the land portion is not present at the enlarged cavity.

* * * * *